US006509821B2

(12) United States Patent
Oldfield

(10) Patent No.: US 6,509,821 B2
(45) **Date of Patent: *Jan. 21, 2003**

(54) LUMPED ELEMENT MICROWAVE INDUCTOR WITH WINDINGS AROUND TAPERED POLY-IRON CORE

(75) Inventor: William W. Oldfield, Redwood City, CA (US)

(73) Assignee: Anritsu Company, Morgan Hill, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/027,087

(22) Filed: Feb. 20, 1998

(65) Prior Publication Data

US 2002/0057183 A1 May 16, 2002

(51) Int. Cl.[7] ..... H01F 27/02

(52) U.S. Cl. ..... 336/82; 336/200; 336/221; 336/231; 336/233

(58) Field of Search ..... 336/82, 83, 200, 336/205, 206, 223, 232, 222, 230, 231, 233

(56) References Cited

U.S. PATENT DOCUMENTS

| | | | | |
|---|---|---|---|---|
| 1,727,932 A | * | 9/1929 | Medved | 336/200 |
| 2,255,730 A | * | 9/1941 | Frazier | 336/200 |
| 2,351,604 A | | 6/1944 | Ferrill, Jr. | 175/359 |
| 2,442,776 A | * | 6/1948 | Newkirk | 336/200 |
| 2,547,412 A | | 4/1951 | Salisbury | 250/20 |
| 3,812,438 A | | 5/1974 | Hopfer | 333/97 |
| 4,087,791 A | * | 5/1978 | Lemberger | 340/152 T |
| 4,236,127 A | | 11/1980 | Scherba | 333/175 |
| 4,343,029 A | * | 8/1982 | Renga et al. | 361/315 |
| 4,429,314 A | * | 1/1984 | Albright | 343/788 |
| 4,543,208 A | * | 9/1985 | Horie et al. | 336/233 |
| 4,893,105 A | * | 1/1990 | Maeda et al. | 336/84 M |
| 4,947,065 A | * | 8/1990 | Ward et al. | 310/44 |
| 5,321,965 A | * | 6/1994 | Baird | 72/142 |
| 5,679,402 A | | 10/1997 | Lee | 427/127 |
| 5,715,531 A | * | 2/1998 | Liu et al. | 455/307 |
| 5,838,215 A | | 11/1998 | Gu et al. | 333/181 |

FOREIGN PATENT DOCUMENTS

| | | | |
|---|---|---|---|
| JP | 4-115507 | * | 4/1992 |

* cited by examiner

*Primary Examiner*—Lincoln Donovan
*Assistant Examiner*—Tuyen Nguyen
(74) *Attorney, Agent, or Firm*—Fliesler, Dubb, Meyer & Lovejoy, LLP

(57) ABSTRACT

A microwave inductor including a coil with windings tapered from a first end of the coil to a second end of the coil to reduce resonant loss glitches found in conventional inductors which have uniform diameter windings. The coil further includes a core composed of a dielectric material containing a colloidal suspension of magnetic particles, the magnetic material preferably being iron powder and the dielectric preferably being epoxy, making the core a poly-iron material. The magnetic particles being colloidally suspended in dielectric increase the impedance of the coil at high frequencies to reduce resonant glitches without lowering the low frequency Q of the inductor. As such, a single coil can be utilized both in a filter which requires a low impedance at low frequencies to create a high Q, and as a bias line which operates at frequencies well beyond the resonant frequency of the inductor since a high impedance is provided by the core at higher resonant frequencies. The percentage of magnetic particles relative to the dielectric material in the core can be controlled to set the inductance value for the microwave inductor.

4 Claims, 3 Drawing Sheets

LUMPED ELEMENT MICROWAVE INDUCTOR WITH WINDINGS AROUND TAPERED POLY-IRON CORE

BACKGROUND OF THE INVENTION

1. Field of the Invention

The present invention relates to lumped element inductors for use in very high frequency microwave applications, and more particularly to such inductors configured to operate over a wide bandwidth and to have a high low frequency Q.

2. Description of the Related Art

Lumped element inductors are commonly used in sub-microwave applications. Such inductors are typically used as elements in a filter, or as bias coils for injecting current into a transmission line of a circuit without disturbing the impedance of a transmission line. Such inductors generally include a coil of thin wire with either air, ceramic, or a ferrite material in the center of the coil.

Most lumped element inductors do not work adequately at microwave frequencies, especially over broad frequency ranges. The problem is intercoil capacitance which resonates with the coil inductance and produces a "glitch" at one or more frequencies where insertion loss through the coil will be significant. A glitch occurs at the Self Resonant Frequency (SRF) of the coil and is well recognized.

Generally, the larger the inductance of the coil, the higher the intercoil capacitance, and the lower the SRF for the coil. As the diameter of windings, diameter of the coil wire, and the number of turns of the coil are decreased, the coil will have a lower intercoil capacitance and a higher SRF, but the coil will also have a lower inductance. As the diameter of the turns get reduced to zero, the inductor becomes a distributed element and operates over a very limited frequency range. An example is a quarter wave shorted bond wire.

A well known technique for increasing the inductance of a coil is the use of a ferrite or other magnetic material core. A coil wrapped around a ferrite core will have much higher inductance than a coil without such a core, but generally intercoil capacitance will also increase and the SRF of the coil will be much lower. A coil with relatively thick wire and a ferrite material core may have a SRF of 25 MHZ, while a coil with thin wire, small diameter turns, and a limited number of turns may have a SRF as high as 10 GHz.

The two major applications of inductive coils, filter elements and bias lines have different requirements. Good filter structures require high Qs, necessitating near perfect inductive components, so inductors which are lossy due to a high resistance or high intercoil capacitance are undesirable. A bias coil merely has to look like a high impedance so that it does not cause mismatches on the transmission line, and the Q is unimportant.

A method of reducing resonant loss glitches is to put a resistor in parallel with the coil or use high resistance wire to make the coil. Unfortunately this also reduces the Q of the inductor making the inductor undesirable for filter structures.

For high frequency microwave applications, it is, thus, desirable to provide an inductor which does not experience significant resonant losses and which operates over a wide bandwidth while providing a high Q.

SUMMARY OF THE INVENTION

The present invention substantially eliminates resonant loss glitches from an inductive coil, while enabling the inductive coil to operate, over a wide bandwidth and provide a high Q at low frequencies.

The present invention is a microwave inductor including a coil with windings tapered from a first end of the coil to a second end of the coil. The diameters of the coil windings are tapered to reduce resonant loss found in typical inductors which have uniform diameter windings. With uniform diameter windings, each coil winding and its associated intercoil capacitance resonates at a common frequency. However, with a tapered coil, each winding and its associated intercoil capacitance is slightly different, and resonant losses are much less pronounced.

The coil further includes a core made up of a dielectric material containing a colloidal suspension of magnetic particles. Preferably, the magnetic material is iron powder, while the dielectric is an epoxy resin, making the core a poly-iron material. With the core made up of magnetic particles colloidally suspended in a dielectric, rather than a conventional core containing a solid mass of ferrite material, the core will have a low resistive loss at low frequencies enabling the coil to have a high Q. The resistive loss will increase at higher frequencies to reduce resonant loss glitches and enable the inductor to function through its SRF to higher frequencies well above its SRF. Further, because the suspended magnetic particles have magnetic permeability, the coil will have an increased inductance at higher microwave frequencies. As such, a single coil can be utilized in both a filter which requires a high Q at low frequencies, and as a bias line which requires a large resistance at high frequencies. By using a core composed of a mixture of magnetic particles and dielectric material, the percentage of magnetic particles relative to the dielectric material can be controlled to set the inductance value for a coil.

BRIEF DESCRIPTION OF THE DRAWINGS

Further details of the present invention are explained with the help of the attached drawings in which.

DETAILED DESCRIPTION

Figure 1A:
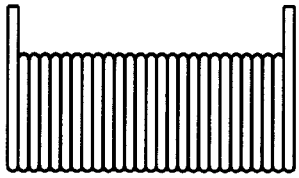
FIG. 1A (Prior Art)
FIG. 1A is a side view of an inductor coil having uniform diameter windings.
Figure 1B:
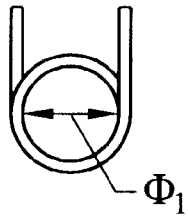
FIG. 1B (Prior Art)
FIG. 1B is a front view of the inductor coil of FIG. 1A.
Figure 2:
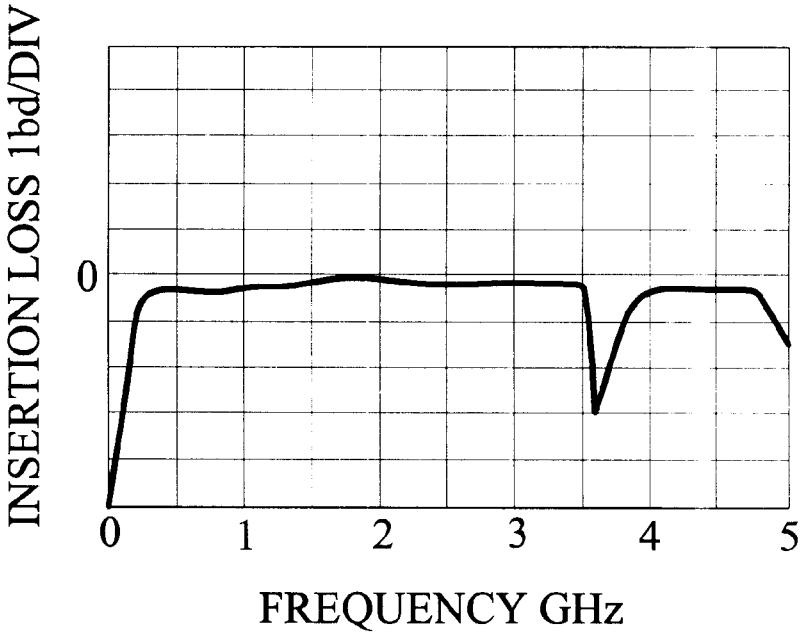
FIG. 2 plots insertion loss vs. frequency for an inductor coil having uniform diameter windings and an air core.

The present invention was realized with recognition that resonant frequency loss is especially pronounced when the diameter of each winding in the coil is uniform. FIGS. 1A and 1B show an inductor coil having windings with a uniform diameter $\phi_1$. With uniform diameter windings, each coil winding and its associated intercoil capacitance resonates at the same frequency. FIG. 2 shows insertion loss vs. frequency for an inductor coil having uniform diameter windings of $\phi_1$=0.020 inches, and 45 turns of 47 gauge wire (0.0013 inch wire diameter) around an air core, giving the coil an inductance of 280 ηH. As shown in FIG. 2, the uniform diameter coil experiences a resonant loss glitch of approximately 3 dB at approximately 3.7 GHz, and another such glitch at approximately 5.0 GHz.

Figure 3A:
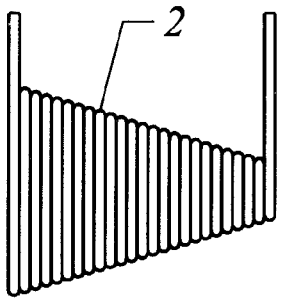
FIG. 3A shows a side view of an inductor coil having windings with diameters tapered from a first end of the coil to a second end.
Figure 3B:
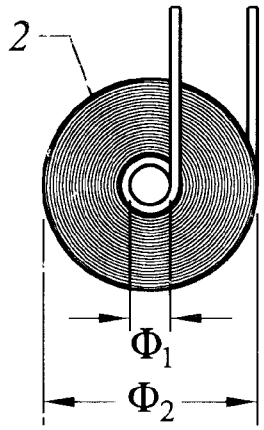
FIG. 3B shows a front view of the inductor coil of FIG. 3A.
Figure 4:
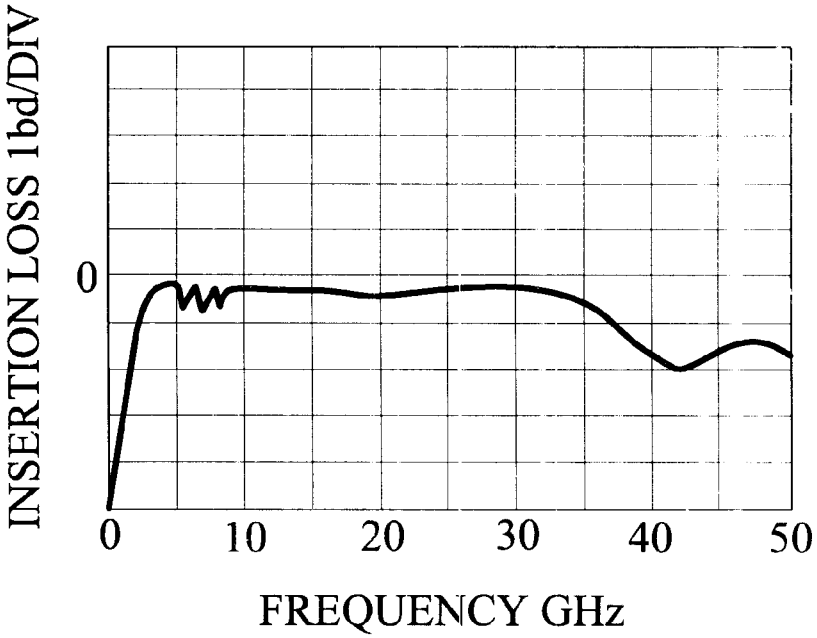
FIG. 4 plots insertion loss vs. frequency for an inductor coil having windings with diameters tapered from a first end of the coil to a second end, wherein the coil has an air core.

The present invention, therefore, utilizes a coil 2 having windings with diameters tapered from a first diameter $\phi_1$ at one end of the coil to a second diameter $\phi_2$ at a second end of the coil as shown in FIGS. 3A and 3B. With a tapered coil 2, each winding and its associated intercoil capacitance is slightly different, and resonant losses are much less pronounced. FIG. 4 shows insertion loss vs. frequency for an inductor coil having windings with diameters tapered from $\phi_1$=0.020 inches to $\phi_2$=0.090 inches, and 60 turns of 47 gauge wire around an air core, giving the coil an inductance of 3.4 ρH. As shown in FIG. 4, the tapered coil has resonant loss glitches between 5 GHz and 10 GHz, but the glitches are much less pronounced than with the uniform diameter coil illustrated in FIG. 2. However, resonant glitches are not eliminated and minor glitches still occur at various frequencies.

At high microwave frequencies, a small diameter core will be needed to reduce intercoil capacitance so that low frequency SRF loss glitches do not occur. However, in high frequency microwave applications a high inductance value may still be needed, and with a small diameter coil, an air core cannot provide such an inductance. As indicated above, a conventional ferrite core can increase inductance, but the conventional ferrite core will also lower the SRF of the inductor.

The present invention was, therefore, further developed with realization that the Q of inductors in filter structures is not as important when frequency is in the range where the filter elements are resonant, or near their cut-off frequencies. Inductors used in filters are typically chosen so that operation frequency of the filter is well below the SRF of the inductors. Therefore, if resistance is introduced to a coil that reduces the Q below the SRF of the coil, but does not affect the Q at lower frequencies, an inductor could be created which is useful both as a bias line and a filter element.

Figure 5A:
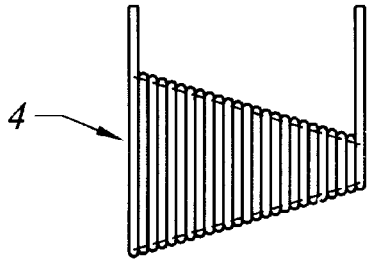
FIG. 5A shows a side view of an inductor coil having windings with diameters tapered from a first end of the coil to a second end, wherein the coil has a core composed of magnetic particles colloidally suspended in dielectric.
Figure 5B:
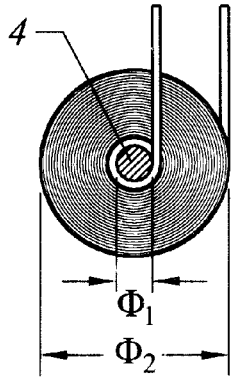
FIG. 5B shows a front view of the inductor coil of FIG. 5A.

The present invention, thus, utilizes a material 4 which be provided as a core of an inductor coil as illustrated in FIGS. 5A and 5B which can enable the coil to provide a high Q at lower frequencies and a high resistance at higher frequencies. The core material is composed of a dielectric material with a colloidal suspension of magnetic particles, the material preferably being poly-iron. The magnetic particles utilized could include iron powder, or other ferromagnetic particles. However, ferrite particles are less desirable than pure iron powder because the permeability of the ferrite particles will change as current is applied, causing the impedance of a coil with a ferrite particle core to change more significantly with the amount of applied current than a coil having an iron powder core. The dielectric material may be a polymeric material such as an epoxy resin, or a crystalline material such as glass.

Magnetic particles, such as powdered iron or ferromagnetic particles, are typically electrically lossy, but the loss occurs only at high frequencies. The dielectric material, such as epoxy, serves to coat each magnetic particles so that the particles are not in direct contact with each other, but are capacitively coupled. Being separated, the magnetic particles do not conduct electrical signals at DC or low frequencies, unlike a solid ferrite core typically provided in an inductor, but with inductive coupling even though the particles are separated they will conduct electrical signals as frequency increases. Therefore, the dielectric material with a colloidal suspension of magnetic particles can provide little loss at low frequencies and can also provide a high loss at high frequencies, as desired. The magnetic flux provided from the magnetic particles also greatly increases the inductance of a coil.

Figure 6:
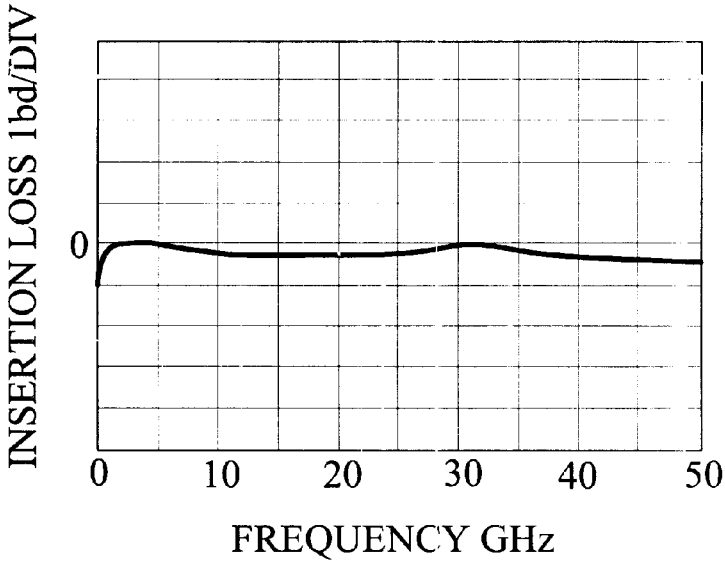
FIG. 6 plots insertion loss vs. frequency for an inductor coil having windings with diameters tapered from a first end of the coil to a second end, wherein the coil has a poly-iron core.

FIG. 6 shows insertion loss vs. frequency for an inductor coil having windings with diameters tapered from $\phi_1$=0.015 inches to $\phi_2$=0.065 inches, and 65 turns of 47 gauge wire around a poly-iron core, giving the coil an inductance ranging from 750 ηH to 2000 ηH, depending on the ratio of iron particles to dielectric in the poly-iron core. As shown in FIG. 6, the tapered coil with a poly-iron core does not experience any significant glitches in the 5–10 GHz range, as did an inductor using an air coil as shown in FIG. 4. Further, the tapered coil using a poly-iron core does not experience losses above 30 GHz, as did the tapered coil with an air core. In fact with a tapered coil using a poly-iron core, an inductor can function from as low as 10 MHz through typical SRF ranges of 3–5 GHz to frequencies higher than 40 GHz.

As indicated above, the percentage of magnetic particles relative to the dielectric material making up the core for the coil can be varied to control the inductance value of the coil. For example, if a low inductance is desired, the core material could include less than 5% magnetic particles to greater than 95% dielectric material. If a high inductance is desired, the poly-iron material could include greater than 90% magnetic particles to less than 5% dielectric material.

With coil windings provided around a tapered core, use of the dielectric in a liquid form during manufacturing allows the dielectric to flow into the smallest winding diameters of the coil where it is the most effective at reducing high frequency resonant loss glitches. The dielectric material after it cures or hardens will then tend to hold the coil together making the coil less susceptible to handling damage.

To manufacture an inductor having windings around a tapered core, with the core including a dielectric material with a colloidal suspension of magnetic materials, wire is initially wound in a toroidal fashion around a tapered mandrel. An adhesive can then be applied to the wire to bind the windings together, and the wire can then be removed from the mandrel. The wire can also have an adhesive material coating its outer surface prior to being wound on the coil, and then immersed in a solvent which activates the adhesive causing the windings to be bound together before the coil is removed from the mandrel. With epoxy used as the dielectric material for the core, the epoxy can be mixed with the appropriate percentage of magnetic material and then poured into the center of the windings for the coil. Temperature, or the material content of the epoxy can be controlled so that the viscosity of the epoxy enables the epoxy to cure within the center of the windings of the coil without running out.

In sum, the present invention includes a coil with windings in the shape of a taper beginning with a very small diameter and gradually increasing. The core of the coil is composed of a dielectric material with a colloidal suspension of magnetic particles, the material preferably being poly-iron, the core functioning to increase impedance at higher frequencies to reduce resonant loss glitches, while providing a low impedance at low frequencies to provide a high Q at low frequencies. Further. the poly-iron core enables a 3 to 1 increase in inductance.

Although the present invention has been described above with particularity, this was merely to teach one of ordinary skill in the art how to make and use the invention. Many other modifications will fall within the scope of the invention, as that scope is defined by the claims provided below.

What is claimed is:

1. An inductor comprising:

a coil of wire having winding turns surrounding an interior space, wherein the winding turns have diameters tapered from a small end of the coil to a large end of the coil, and wherein the winding turns have diameters of about 0.015 inches and greater; and a core provided in the interior space of the coil, wherein the core comprises a colloidal suspension of magnetic particles in a dielectric material, wherein the core comprises less than 90% magnetic particles, wherein the dielectric material has been allowed to cure at about atmospheric pressure after being poured into the interior space of the winding turns, wherein the core does not extend beyond the small end of the coil, and wherein the core is conically shaped.

2. The inductor of claim 1, wherein the core contacts all of the winding turns of the coil of wire from the small end to the large end.

3. The inductor of claim 1, wherein the core comprises poly-iron.

4. The inductor of claim 1, wherein the core comprises greater than 40% magnetic particles.

* * * * *